United States Patent [19]

Pask

[11] 4,375,891

[45] Mar. 8, 1983

[54] SEAL BETWEEN A TURBINE ROTOR OF A GAS TURBINE ENGINE AND ASSOCIATED STATIC STRUCTURE OF THE ENGINE

[75] Inventor: George Pask, Stanton-by-Bridge, England

[73] Assignee: Rolls-Royce Limited, London, England

[21] Appl. No.: 256,146

[22] Filed: Apr. 21, 1981

[30] Foreign Application Priority Data

May 10, 1980 [GB] United Kingdom ..... 8015556

[51] Int. Cl.[3] ..... F01D 5/08; F01D 5/18; F16J 15/16

[52] U.S. Cl. ..... 277/3; 277/27; 277/91; 415/115; 416/95

[58] Field of Search ..... 416/95, 174; 305/11; 277/3, 27, 91; 415/115, 110

[56] References Cited

U.S. PATENT DOCUMENTS

| | | | |
|---|---|---|---|
| 2,733,567 | 2/1956 | Zellweger | 305/11 |
| 2,908,516 | 10/1959 | Stein | 277/201 |
| 3,499,653 | 3/1970 | Gardner | 277/27 |
| 3,516,678 | 6/1970 | Stein | 277/91 |
| 3,575,528 | 4/1971 | Beam | 415/115 |
| 4,082,296 | 4/1978 | Stein | 277/3 |
| 4,213,738 | 7/1980 | Williams | 416/95 |
| 4,217,755 | 8/1980 | Williams | 415/115 |

FOREIGN PATENT DOCUMENTS

| | | | |
|---|---|---|---|
| 648824 | 1/1951 | United Kingdom . | |
| 1434492 | 5/1976 | United Kingdom . | |
| 2064016 | 6/1981 | United Kingdom | 416/95 |

*Primary Examiner*—Robert I. Smith

*Attorney, Agent, or Firm*—Cushman, Darby & Cushman

[57] ABSTRACT

A seal for use between the turbine rotor of a gas turbine engine and associated static structure comprises a ring of low-friction material which cooperates with the surface of the rotor to form an air bearing. The ring carries a sealing member which cooperates with a surface of the rotor to form a seal. The air bearing ensures that the sealing member is maintained at a constant spacing from the rotor, and this spacing may thus be maintained at a low value.

7 Claims, 3 Drawing Figures

SEAL BETWEEN A TURBINE ROTOR OF A GAS TURBINE ENGINE AND ASSOCIATED STATIC STRUCTURE OF THE ENGINE

This invention relates to a seal between a turbine rotor of a gas turbine engine and associated static structure of the engine.

The turbine rotors of gas turbine engines are often provided with cooling air, which is normally arranged to be at a pressure greater than that of the gas in the main flow annulus of the engine at its entrance to the rotor. This is done, amongst other reasons, to avoid the possibility of hot gas flowing inward from the annulus into the spaces round the rotor and possibly damaging the rotor.

However, it is important to prevent this cooling air from leaking in any substantial quantities into the main gas flow annulus, because the leakages represent a waste of cooling air and interfere with the efficient operation of the turbine. Both these effects reduce the efficiency of the engine. In the past various forms of seal have been used with varying success, but the difficulty of sealing between relatively rotating parts having various differential thermal, centrifugal and vibrational movements makes this a serious problem.

The present invention provides a seal which rides on the rotor so that differential movements become less difficult to cope with.

According to the present invention a seal between the turbine rotor of a gas turbine engine and associated static structure comprises a ring of low friction material carried from the static structure coaxially with the rotor, said ring and rotor being shaped to form between them an air bearing, and an annular sealing member carried from said ring and cooperating with an annular surface of the rotor to form a seal.

The rotor may be formed with an annular array of lift pads in its surface which cooperate with the surface of said ring to form said air bearing.

In one embodiment the sealing member is located radially outside the ring and nozzles are provided to direct cooling air into the rotor in between the ring and the sealing member.

The ring may be carried in an open triangulated frame which also has formed on an annular part of its surface axially projecting fins which comprise said sealing member.

We prefer the ring to be of a ceramic material such as silicon nitride or carbide.

Figure 1:
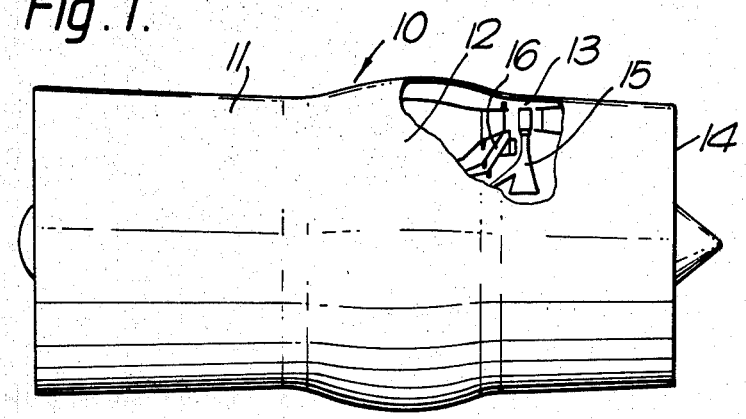
Figure 3:
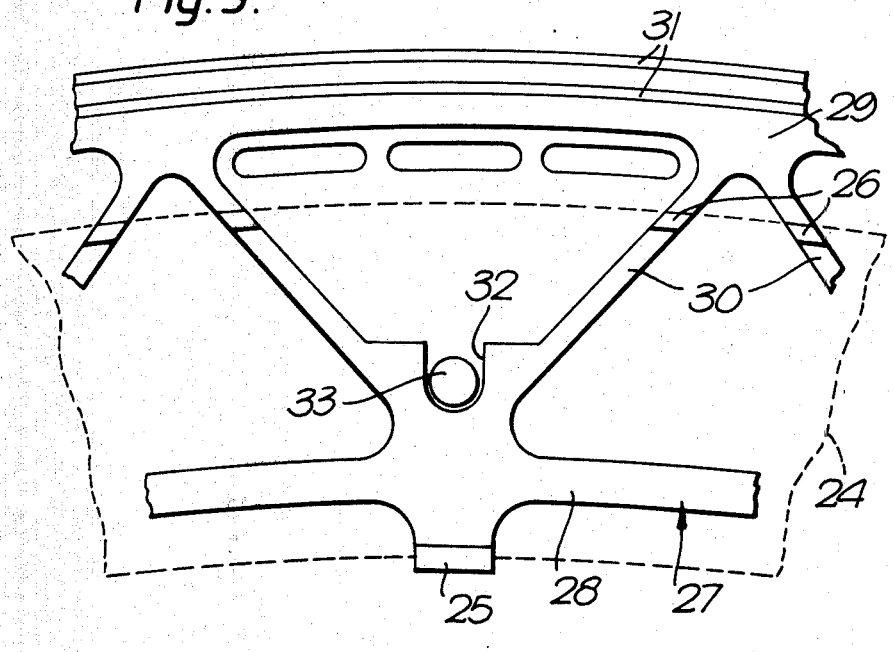
Figure 2:
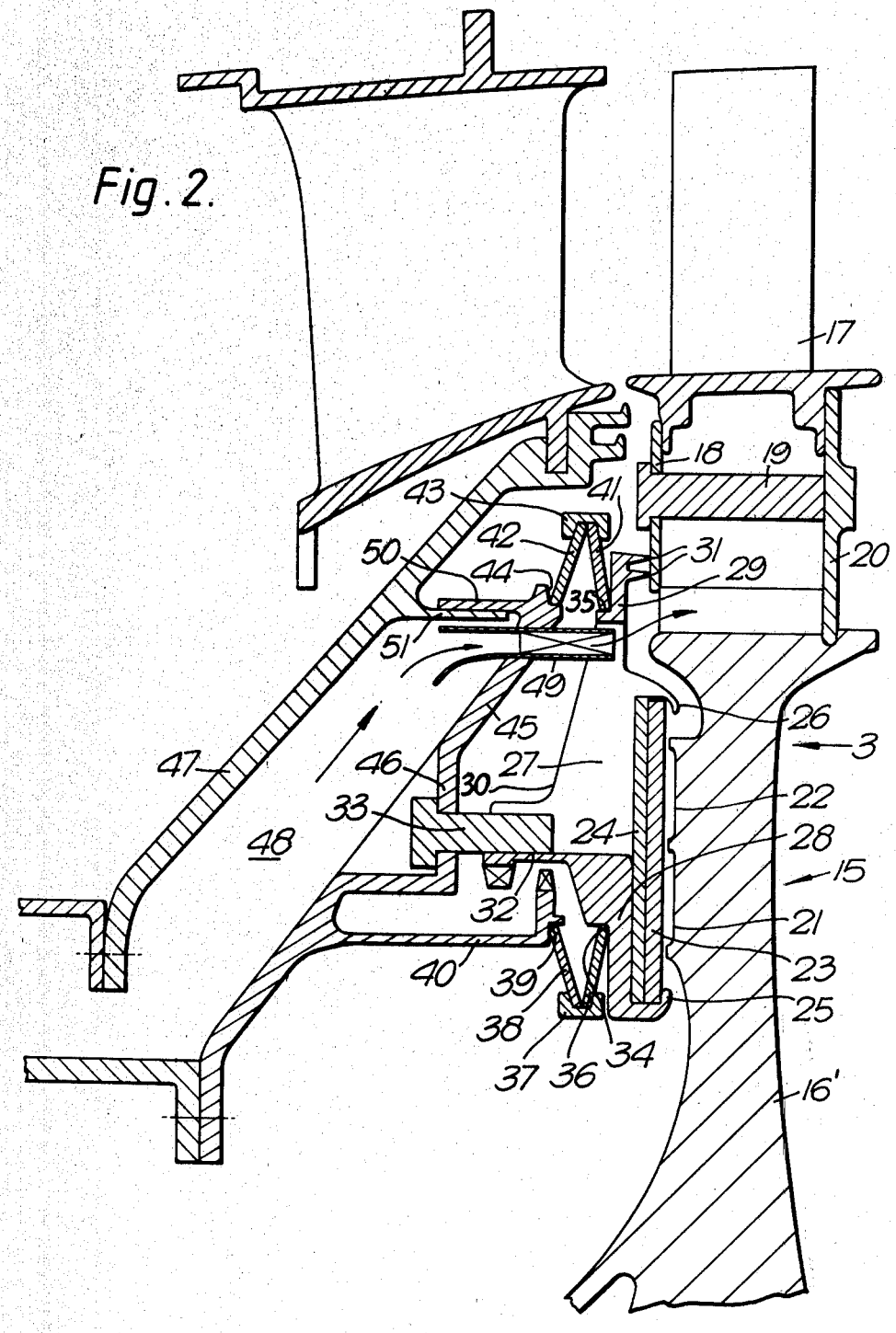

The invention will now be particularly described merely by way of example, with reference to the accompanying drawings in which:

FIG. 1 is a partly broken-away view of a gas turbine engine having a seal in accordance with the invention, FIG. 2 is an enlarged section of part of the turbine of FIG. 1 illustrating the seal, and FIG. 3 is a view of the seal on the arrow 3 of FIG. 2.

FIG. 1 shows a gas turbine engine 10 comprising a compressor section 11, combustion chamber 12, turbine 13 and final nozzle 14. The engine operates overall in a conventional manner which will not be elaborated here. It should be noted at this point that although described as a complete entity, the engine 10 could well comprise the core of a larger engine, such for instance as a fan engine.

It is well known that the sealing between the turbine rotor 15 of the engine and its associated static structure as at 16 is important to the efficiency of the engine, and FIG. 2 shows in more detail how the seal of the present invention is constructed.

Referring to FIG. 2, the turbine rotor 15 is seen to comprise a rotor disc 16' from the periphery of which a plurality of rotor blades 17 are supported by the normal fir-tree root structure. It is noteworthy that an annular plate 18 is held against the upstream face of the shanks of the blades 17 by a plurality of studs 19 which extend from respective ones of an annulus of seal plates 20 retained against the rear faces of the blade shanks.

The annular plate 18 in this instance therefore provides a flat annular surface on the upstream face of the rotor with which a sealing member may cooperate. It should, however, be noted that it would be possible to form the plate 18 with annular fins which interdigitate with those of a sealing member.

The rotor disc 16' is conventional in form except for the upstream face which is provided with two concentric annular arrays of lift pads at 21 and 22. The arrays are adjacent to one another, and each consists of a plurality of shallow depressions bounded by walls on all sides except that facing the direction of motion of the disc. This will be recognised as a well-known type of air bearing. Although two arrays of pads are described it is clearly possible to use one or more such arrays to suit the circumstances. It is also quite possible to arrange that the pads are formed in the static part (the ring 23) instead of in the rotor surface.

The pads 21 and 22 coact with a ceramic annulus 23 to form the complete air bearing structure. The annulus 23 comprises a thin annulus of Silicon Carbide whose faces are transverse to its axis and having at least that face which cooperates with the pads 21 and 22 accurately formed in a plane.

The annulus 23 is backed by a similar metal annulus 24 and the complete composite annulus is held by inner and outer claws 25 and 26 respectively in a triangulated annular frame 27. The shape of the frame 27 is more easily seen in FIG. 3, in which it will be noted that the annuli 23 and 24 are drawn as if transparent in broken lines so that the complete structure of the frame is visible.

From FIG. 3 it will be seen that the frame 27 consists of inner and outer rings 28 and 29 interconnected by links 30 of the triangulated structure 27. From the inner ring 28 extend the claws 25, while the upper portions of the links 30 carry the claws 26. The outer ring 29 extends outwardly to form adjacent its radially outer periphery a pair of sealing fins 31 (visible in section in FIG. 2) which cooperate with the surface of the plate 18 as mentioned above to provide a seal. The other feature of the framework 27 visible in FIG. 3 comprises an axially extending channel 32 open at its radially outer extent and in which locates a pin 33 whose function is to prevent circumferential motion and to maintain concentricity of the framework and hence of the annuli 23 and 24.

The remaining features of the construction are best seen from FIG. 2. It is clear that the framework 27 and annuli 23 and 24 must be carried from, and sealed to static structure of the engine. Accordingly, the rings 28 and 29 are provided in their rearward faces with annular steps 34 and 35 respectively. In the step 34 engages a conical frusto or Belleville washer 36 which is retained by a U-section ring 37 to a second, oppositely handed frusto conical or Belleville washer 38. The washer 38 engages in an annular step 39 facing the step 34 and formed in an axially extending annular flange 40 forming part of the static structure of the engine.

In a similar manner the step 35 of ring 29 is engaged by a similar pair of opposite handed Belleville washer 41 and 42 retained together by a U-section ring 43, the washer 42 engaging with a further step 44 formed in the outer periphery of a conical flange 45. The flange 45 also has formed therein pockets 46 within which are retained the pins 33.

The pairs of washers 36, 38 and 41, 42 and their retaining rings 37, 43 together form combinations of seals and springs which load the frame 27 and hence the ceramic annulus 23 toward the rows of lift pads 21 and 22. Because the washers are held together at their abutting peripheries by the U-section rings but are not prevented from relative angular displacement of their sections, a wide range of axial movement between the frame 27 and the static structure may be accommodated without unduly stressing the washers. Also, as long as the washers are spring loaded against one another and against the respective annular steps, an effective seal is also provided.

Therefore, the framework 27 and the ceramic ring 23 and seal members 31 which depend from it are mounted sealingly from the fixed structure comprised by the flanges 40 and 45, and are able to move axially to follow any axial motion of the rotor 15 relative to the fixed structure. The engagement between the pins 33 and the channels 32 forms a cross-key location which maintains the framework coaxial with the rotor and prevents rotation but allows radial expansion.

In order to provide the necessary cooling air to the blades 17 and also to provide the pressures necessary to pressure balance the frame 27, the conical flange 45 and a similar flange 47 spaced apart from it define a channel 48 for cooling air bled from the compressor section 11 of the engine. This air flows along the channel 48 and through a series of preswirl nozzles 49 in which the air is given a component of motion in the same direction as the rotation of the rotor 15. The air is precluded from otherwise escaping from the channel 48 by flanges 50 and 51 which extend from the conical flanges 45 and 47 respectively and sealingly engage with one another to complete the sealing of the channel 48.

Air which blows from the nozzles 49 passes through the spaces between the links 30 outside the outer periphery of the rings 23 and 24 and flows under the plate 18 to the roots of the blades 17, there to enter cooling passages (not shown) within the blades to cool them. This cooling air is prevented from escaping radially outwardly to rejoin the main gas flow annulus of the engine mainly by virtue of the seal formed between the fins 31 and the surface of the plate 18 and consequently the clearance between these should ideally be controlled to a constant very small value.

The construction described above enables this to be carried out by virtue of the operation of the annulus 23 and the lift pads 21 and 22 acting as an air bearing. It is a known attribute of these bearings that they operate to maintain a constant, small clearance between the static and rotating members, and in this way the annulus 23 retains in operation an almost constant position relative to the rotor disc 16. The seal fins 31 are positioned axially by the frame 27 and hence by the annulus 23, thus these fins also maintain a clearance from the annulus 18 which may be very small.

In addition to maintaining an overall clearance, the annulus 23 and its supporting structure are arranged to be flexible. In this way the seal structure can follow distortions of part of the rotor as well as movements of the entire rotor. This may be necessary to enable the seal to cope with vibrational movements of the disc, which often produce distortions of the 'standing wave' type.

It will be understood that the embodiment described above could be modified in various ways to suit the particular conditions. Thus although the Silicon Carbide annulus 23 referred to above uses a material which has low friction and is heat resistant, there are other materials which could be used amongst which are a wide variety of other ceramics such as Silicon Nitride and other nonmetallic materials such as Carbon and in some circumstances metals which may be faced with low friction material may be used. Again, as mentioned above it may be desirable to arrange the air bearing pockets in the static rather than the rotary part of the structure.

In addition, it will be understood that the mechanical details of the construction are susceptible to alteration to fit particular circumstances.

I claim:

1. In a gas turbine engine having a turbine rotor and associated static structure, the improvement in a seal structure between the turbine rotor and the associated static structure comprising:

a flexible open triangulated supporting frame coaxial with said turbine rotor and having an inner ring and an outer ring connected together by links;

means operatively carrying said triangulated supporting frame from said static structure, said means permitting relatively axial movement of said triangulated supporting frame relative to said static structure and to said rotor without permitting relative rotational movement between said triangulated supporting frame and said static structure;

a thin flexible annulus of low friction material carried by one ring of said triangulated frame structure, said annulus of low friction material having a face opposing a first annular surface on said rotor and forming therebetween an air bearing;

an annular air seal between said turbine rotor and said triangulated supporting frame, said seal being defined by a second annular surface on said turbine rotor and a plurality of axially projecting fins from the other ring cooperating with said second annular surface of said rotor; and said flexible open triangulated supporting frame and said thin flexible annulus of low friction material accommodating distortions and vibrational movements of said turbine rotor thereby permitting said fins to follow said rotor.

2. A gas turbine engine as claimed in claim 1 and in which said rotor is formed with an annular array of lift pads in said first annular surface which cooperate with the face of said flexible ring to form said air bearing.

3. A gas turbine engine as claimed in claim 1 in which said air seal is located radially outward of said air bearing.

4. A gas turbine engine as claimed in claim 3 including a plurality of nozzles carried by said static structure and positioned between said air bearing and said air seal, said nozzles being arranged to direct cooling air through said triangulated supporting frame to the turbine rotor.

5. A gas turbine engine as claimed in claim 1 in which said means operatively carrying said supporting frame from said static structure includes pins extending axially from said static structure, and channels formed in one of said rings of said triangulated frame, said channels extending axially and receiving the axially extending pins whereby circumferential movement of said triangulated frame is prevented.

6. A gas turbine engine as claimed in claim 1 in which each of said rings of said triangulated frame is provided with an annular portion and in which further seals are provided between said annular portions and said static structure.

7. A gas turbine engine as claimed in claim 6 and in which each of said further seals comprises a pair of coned washers of alternate hand and a U-section ring which holds abutting peripheries of said washers together, said annular portions of the frame and said static structure comprising annular steps with which the free peripheries of said abutting washers engage.

* * * * *